US007180463B2

(12) United States Patent
Chung

(10) Patent No.: US 7,180,463 B2
(45) Date of Patent: Feb. 20, 2007

(54) DUAL-BAND ANTENNA

(75) Inventor: Cho-Ju Chung, Tu-Cheng (TW)

(73) Assignee: Hon Hai Precision Industry Co., Ltd. (TW)

( * ) Notice: Subject to any disclaimer, the term of this patent is extended or adjusted under 35 U.S.C. 154(b) by 0 days.

(21) Appl. No.: 10/955,620

(22) Filed: Sep. 30, 2004

(65) Prior Publication Data

US 2005/0285802 A1 Dec. 29, 2005

(30) Foreign Application Priority Data

Jun. 25, 2004 (TW) ..... 93210028 U

(51) Int. Cl.
*H01Q 1/36* (2006.01)

(52) U.S. Cl. ..... 343/824; 343/752; 343/826

(58) Field of Classification Search ..... 343/700 MS, 343/702, 846, 752, 824, 826
See application file for complete search history.

(56) References Cited

U.S. PATENT DOCUMENTS 5,867,131 A * 2/1999 Camp et al. ..... 343/797
5,926,139 A * 7/1999 Korisch ..... 343/702
6,204,819 B1 3/2001 Hayes et al. ..... 343/702
6,515,629 B1 2/2003 Kuo et al. ..... 343/700
6,741,214 B1 * 5/2004 Kadambi et al. .... 343/700 MS

FOREIGN PATENT DOCUMENTS

CN 2577453 Y 10/2003
CN 2600926 Y 1/2004

* cited by examiner

*Primary Examiner*—Michael C. Wimer
(74) *Attorney, Agent, or Firm*—Morris Manning & Martin; Tim Tingkang Xia, Esq.

(57) ABSTRACT

A dual-band antenna includes a ground point, a feeding element, a first radiation element, a second radiation element, and an impedance element. The ground point is electronically connected to the first radiation element and the second radiation element. The first radiation element is electronically connected to the feeding element via a first feeding point, and the second radiation element is electronically connected to the feeding element via a second feeding point. The first radiation element includes a head and a neck. A width of the neck decreases from the head toward the first feeding point. The impedance element extends from the neck and through the first feeding point. The dual-band antenna further includes a support element that is connected to the ground point.

10 Claims, 6 Drawing Sheets

DUAL-BAND ANTENNA

BACKGROUND OF THE INVENTION

1. Field of the Invention

The present invention relates to antennas, and particularly to a dual-band antenna used in wireless local area network (WLAN) devices.

2. Prior Art of the Invention

WLAN communication protocols mainly comprise two standards: IEEE 802.11a and IEEE 802.11b. The working frequency band of IEEE 802.11b is 2.4~2.5 GHz. The working frequency band of IEEE 802.11a covers the range 5.15~5.825 GHz, and comprises 5.15~5.25 GHz, 5.25~5.35 GHz and 5.725~5.825 GHz.

In order to make wireless communication devices compatible for both the 802.11a and 802.11b standards, dual-band or multi-band antennas are required. The Planar Inverted-F Antenna (PIFA) is a kind of small-sized and built-in antenna currently employed in mobile communication devices. However, the electrical volume of the antenna divided by (frequency×gain×efficiency) is a constant. Therefore if the antenna is downsized, the frequency and efficiency thereof are correspondingly reduced. Therefore, the planar inverted-F antenna cannot operate in the three frequency bands of the IEEE 802.11a standard.

One solution for this problem is integrating two or more antennas into one, with each antenna working in one of the frequency bands. An example of such an integrated antenna is disclosed in U.S. Pat. No. 6,204,819 issued on Mar. 20, 2001. The integrated antenna comprises a planar inverted-F antenna and a ring antenna. The integrated antenna can be switched between the planar inverted-F antenna and the ring antenna by selecting different signal feeding means. Because it employs different antenna structures, the integrated antenna can operate in a wider frequency band. For example, certain parameters of the ring antenna can be configured to obtain a wider frequency band. However, the integrated antenna is substantially three-dimensional and occupies a relatively large space, which makes it unsuitable for low profile and small sized applications. In addition, because different signal feeding means are needed to switch between working frequency bands, the integrated antenna has a complicated structure and high costs.

SUMMARY OF THE INVENTION

Accordingly, an objective of the present invention is to provide a small size antenna that is capable of dual-band communication.

In order to accomplish the above-mentioned objective, a dual-band antenna printed on a substrate for radiating radio frequency signals comprises a feeding element, a first feeding point electronically connected to the feeding element, a second feeding point electronically connected to the feeding element, a first radiating element for radiating first radio frequency signals, a second radiating element that is electronically connected to the feeding element by way of the second feeding point for radiating second radio frequency signals, an impedance element electronically connected to the first radiating element by way of the first feeding point, and a ground point that is electronically connected to the first feeding point and the second feeding point. The first radiating element comprises a head and a neck. The neck has two ends: one is connected to the head, and the other is electronically connected to the feeding element by way of the first feeding point. A width of the neck gradually decreases from the head to the first feeding point.

Other objectives, advantages and novel features of the present invention will be drawn from the following detailed description of a preferred embodiment of the present invention with the attached drawings, in which:

DETAILED DESCRIPTION OF PREFERRED EMBODIMENT OF THE INVENTION

Figure 1:
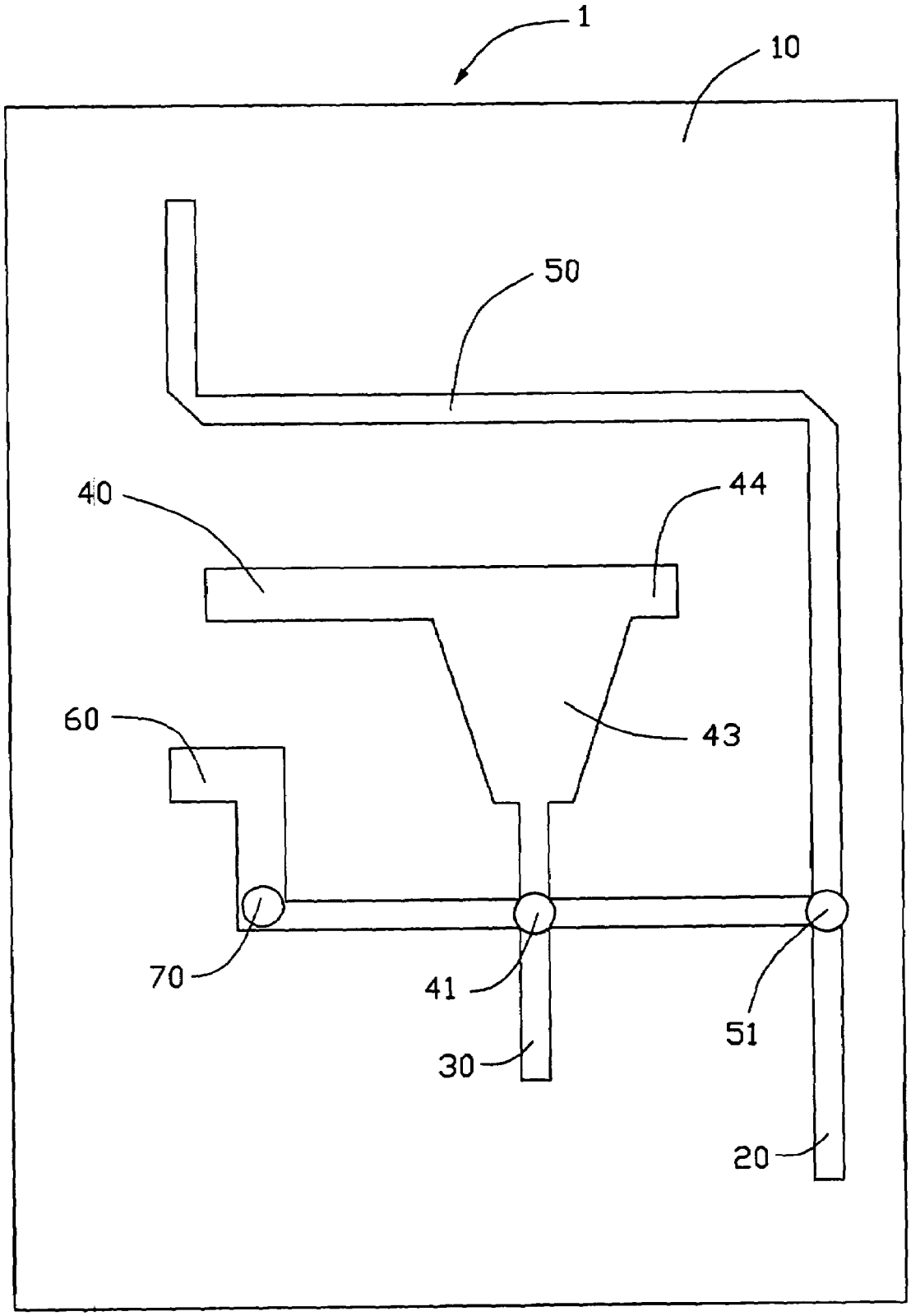
FIG. 1 is a plan view of an antenna in accordance with a preferred embodiment of the present invention.
Figure 2:
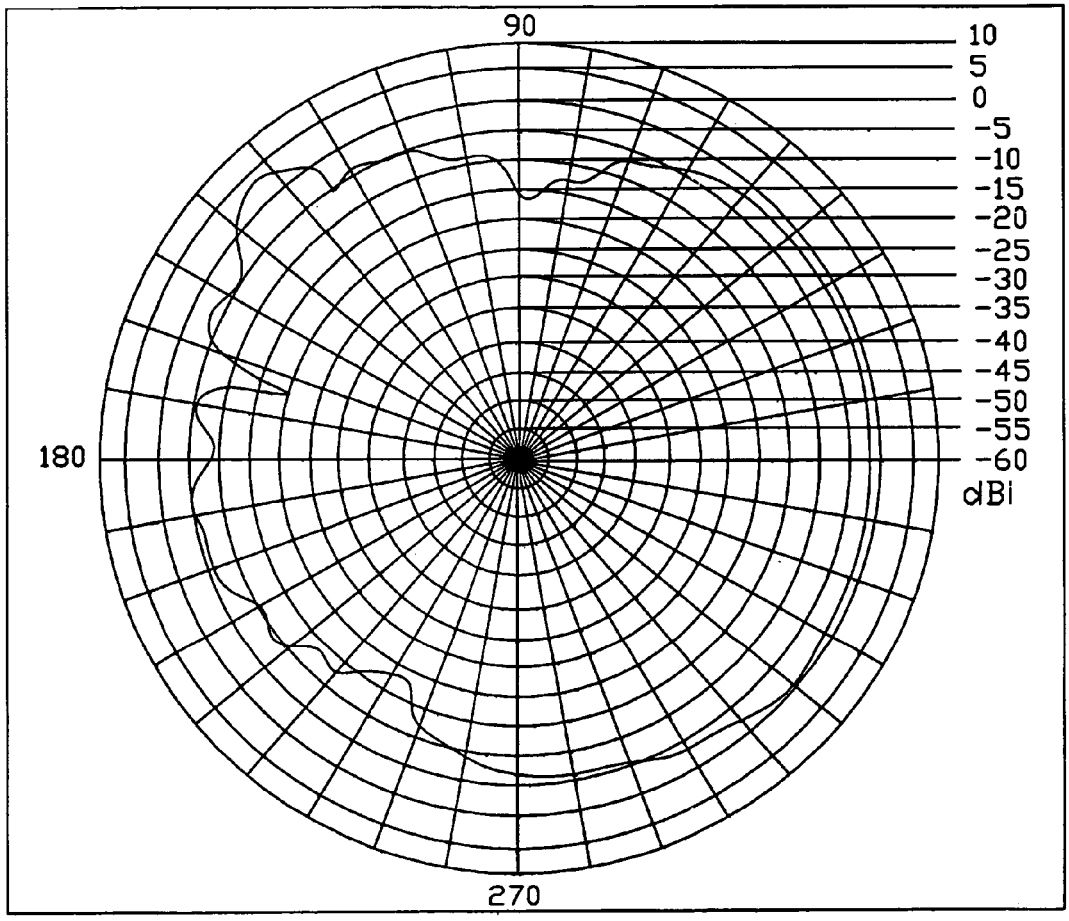
FIG. 2 is a graph showing a measured radiation pattern in a horizontal plane when the antenna of FIG. 1 is operated at 2.45 GHz.
Figure 3:
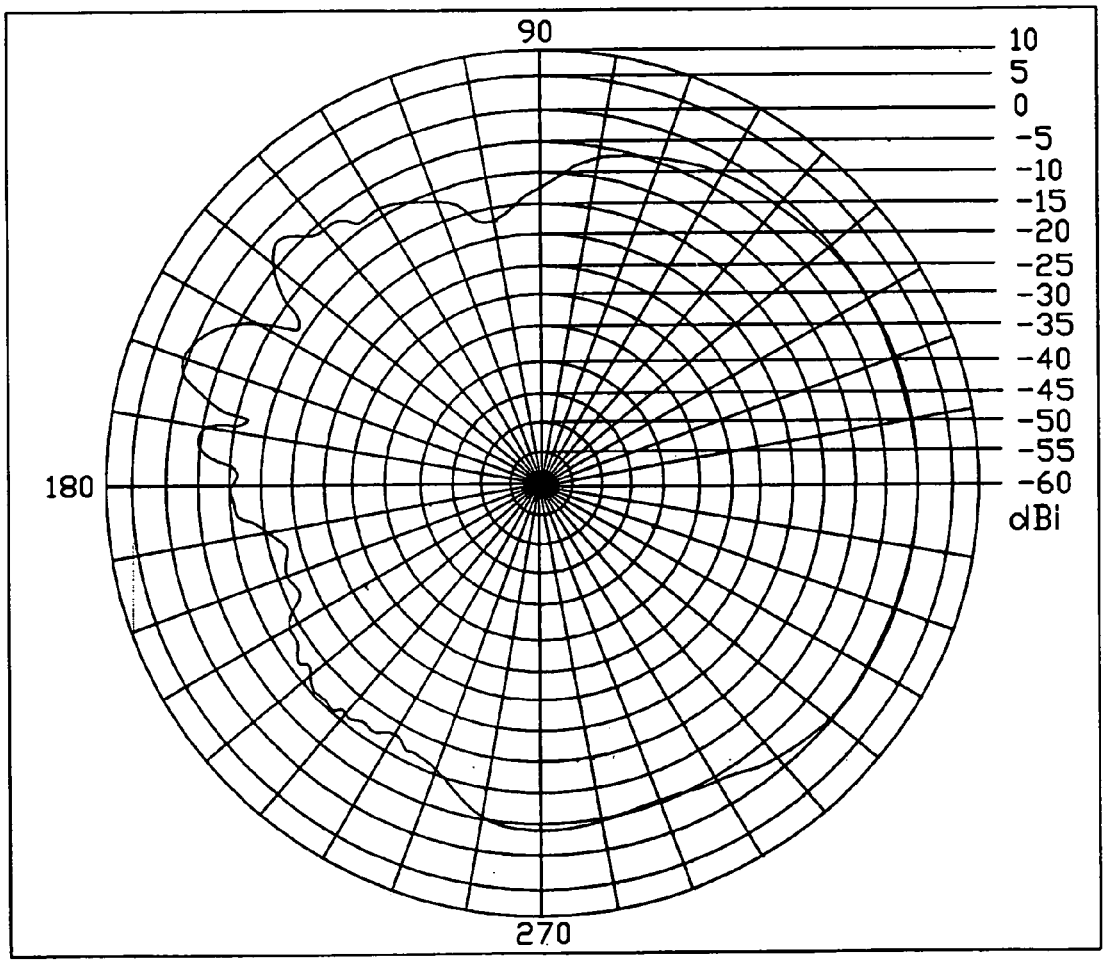
FIG. 3 is a graph showing a measured radiation pattern in a horizontal plane when the antenna of FIG. 1 is operated at 4.9 GHz.
Figure 4:
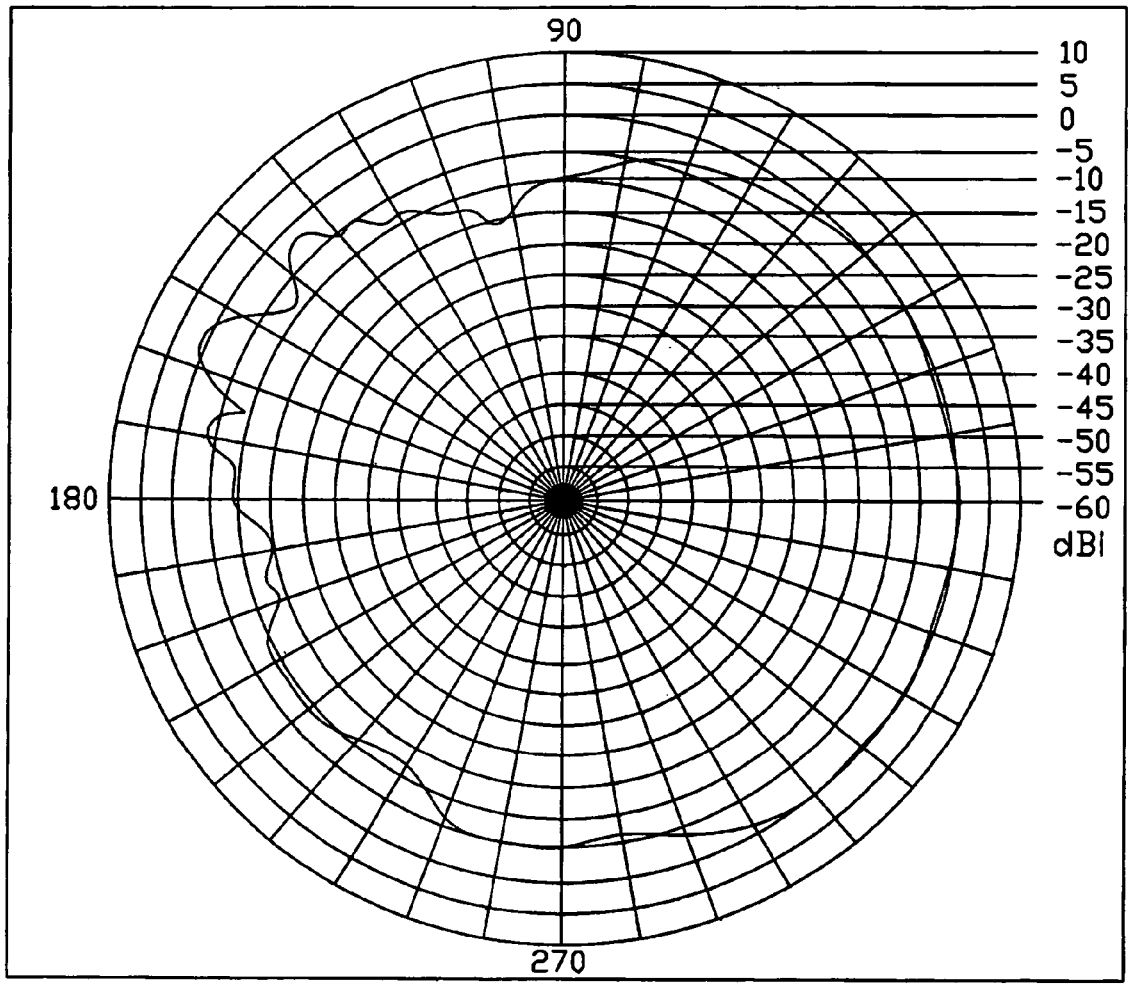
FIG. 4 is a graph showing a measured radiation pattern in a horizontal plane when the antenna of FIG. 1 is operated at 5.25 GHz.
Figure 5:
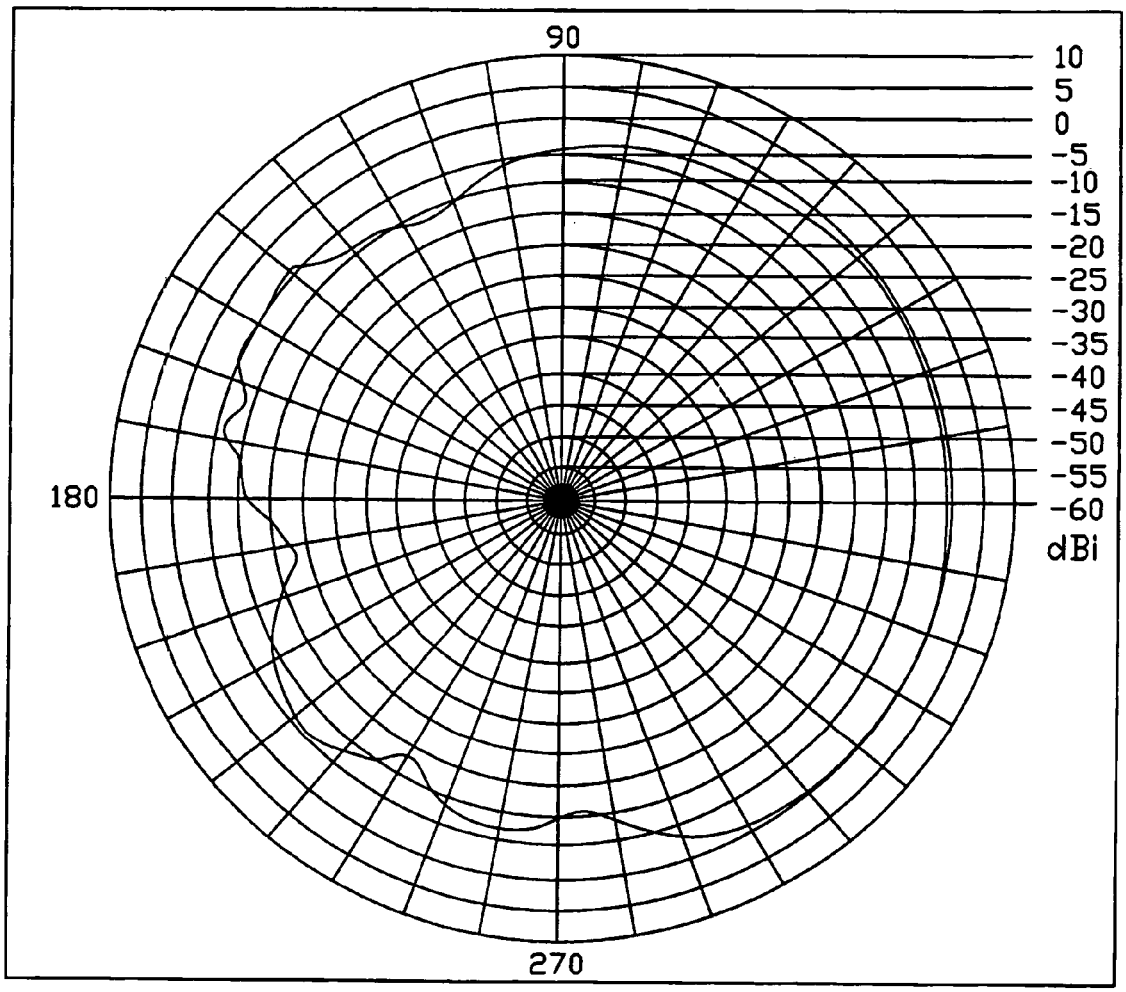
FIG. 5 is a graph showing a measured radiation pattern in a horizontal plane when the antenna of FIG. 1 is operated at 5.825 GHz.

FIG. 1 is a schematic view of a dual-band antenna 1 in accordance with the preferred embodiment of the present invention. The dual-band antenna 1 is printed on a substrate 10, and comprises a signal feeding element 20, an impedance element 30, a first radiating element 40, a first feeding point 41, a second radiating element 50, a second feeding point 51, and a ground point 70.

The signal feeding element 20 is electronically connected to the first feeding point 41 and the second feeding point 51, and provides resonance chambers of about ¼ wavelength respectively for the first feeding point 41 and the second feeding point 51. The first radiating element 40 is connected to the signal feeding element 20 via the first feeding point 41, and is used for radiating high frequency signals. The first radiating element 40 comprises a neck 43 and a head 44. The neck 43 has two ends, one end being connected to the head 44, and the other end being electronically connected to the first feeding point 41. A width of the neck 43 gradually decreases from the head 44 to the first feeding point 41. The configuration of the neck 43 and the head 44 gives the first radiating element 40 an approximate "L" shape. The impedance element 30 is electronically connected to the first radiating element 40 by way of the first feeding point 41, and is used as an impedance match for the first radiating element 40 in order to reduce return loss.

The second radiating element 50 is connected to the signal feeding element 20 by way of the second feeding point 51, and is used for radiating low frequency signals. In the preferred embodiment of the present invention, the second radiating element 50 is disposed at one side of the first radiating element 40, and has an "L" shape similar to that of the first radiating element 40. The second radiating element 50 is separated from the first radiating element 40 a predetermined distance, for reducing return loss. In the preferred embodiment, the predetermined distance is about 1 millimeter. In order to add radiated frequency bandwidth, a radiating end of the second radiating element 50 is bent to provide the "L" shape. This provides a broader radiating area for the second radiating element 50. The length of the bent portion of the radiating end can be configured according to need. In certain cases, the configuration can also reduce the size of the dual-band antenna 1.

A support part 60 is provided at a side of the first radiating element 40 opposite from the second radiating element 50. The support part 60 is electronically connected to the ground point 70. A shape and orientation of the support part 60 is similar to that of the first radiating element 40. The support part 60 is separated from the first radiating element 40 a predetermined distance, for forming a capacitive load. The capacitive load is used as an impedance match to obtain high gains for the dual-band antenna 1. In the preferred embodiment of the present invention, the predetermined distance is approximately 1 millimeter.

FIGS. 2–5 respectively show measured radiation patterns in a horizontal plane when the dual-band antenna 1 is operated at 2.45 GHz, 4.9 GHz, 5.25 GHz, and 5.825 GHz. According to the measured patterns, the dual-band antenna 1 meets gain demands of the four working frequencies, and operates with no radiation dead zones.

Figure 6:
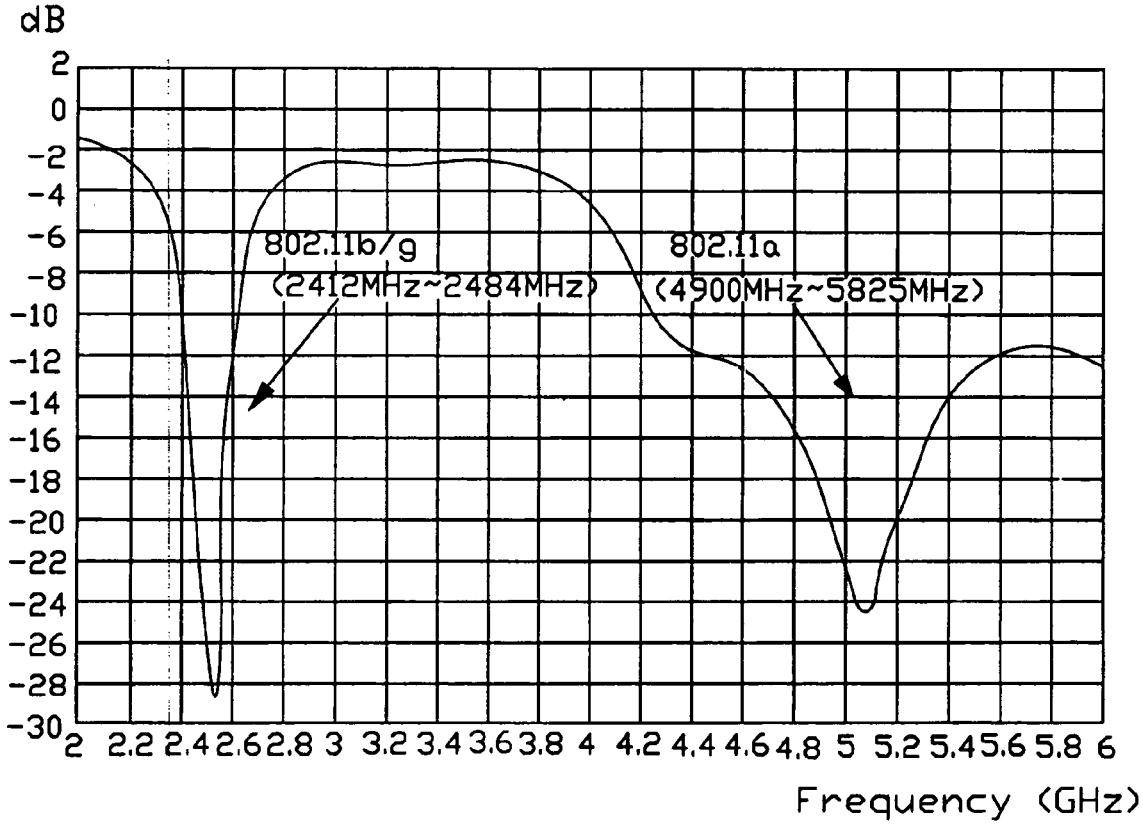
FIG. 6 is a graph showing measured return loss of the antenna of FIG. 1.

FIG. 6 is a graph showing measured return loss of the dual-band antenna 1. As shown, when the dual-band antenna 1 operates in working frequency bands of 2.4~2.5 GHz and 4.3~6 GHz, its return loss is less than −10 dB. This indicates that the working frequency of the dual-band antenna 1 covers all the frequency bands of both the IEEE 802.11a and 802.11b standards.

As will be understood by a person skilled in the art, the foregoing preferred embodiment of the present invention is illustrative of the present invention rather than limitative of the present invention. Various modifications and similar arrangements are included within the spirit and scope of the present invention, and the appended claims should be accorded the broadest reasonable interpretation so that the scope thereof encompasses all such modifications and similar structures.

What is claimed is:

1. A dual-band antenna printed on a substrate for radiating radio frequency signals, the dual-band antenna comprising:

a feeding element;

a first feeding point electronically connected to the feeding element;

a second feeding point electronically connected to the feeding element;

a first radiating element for radiating first radio frequency signals, the first radiating element comprising a head and a neck, the neck having two ends, one of the ends being connected to the head, and the other end being electronically connected to the feeding element by way of the first feeding point, a width of the neck gradually decreasing from the head to the first feeding point;

a second radiating element electronically connected to the feeding element by way of the second feeding point, for radiating second radio frequency signals;

an impedance element electronically connected to the first radiating element by way of the first feeding point; and a ground point electronically connected to the first feeding point and the second feeding point.

2. The dual-band antenna as recited in claim 1, wherein the radiating area of the second radiating element is configurable for obtaining a desired frequency band of radiated radio frequency signals.

3. The dual-band antenna as recited in claim 1, further comprising a support part connected to the ground point, for forming a capacitive load together with the first radiating element.

4. The dual-band antenna as recited in claim 3, wherein the support part is spaced approximately 1 millimeter from the first radiating element.

5. The dual-band antenna as recited in claim 1, wherein each of the first radiating element and the second radiating element has an approximate "L" shape.

6. The dual-band antenna as recited in claim 1, wherein the second radiating element is spaced approximately 1 millimeter from the first radiating element.

7. A dual-band antenna for radiating radio frequency signals, comprising:

a feeding element;

a first radiating element located in a preset substrate plane and electrically connected to said feeding element for radiating first radio frequency signals;

a second radiating element located in said plane as said first radiating element and electrically connected to said feeding element for radiating second radio frequency signals and disposed at one side of said first radiating element; and a support part located in said plane as said first and second radiating elements, said support part electrically connected to said first radiating element and separately disposed at another side of said first radiating element opposite to said second radiating element and spaced from said another side of said first radiating element, said support part configured to form a capacitive load.

8. The dual-band antenna as recited in claim 7, wherein said first radiating element is electrically connected to said feeding element via a first feeding point, and said second radiating element is electrically connected to said feeding element via a second feeding point.

9. The dual-band antenna as recited in claim 8, wherein said support part is electrically connected to said first radiating element via a ground point electrically connectable to said first and second feeding points.

10. The dual-band antenna as recited in claim 8, further comprising an impedance element electrically connected to said first radiating element by way of said first feeding point.

* * * * *